US006112926A

United States Patent [19]

Fishman

[11] Patent Number: 6,112,926

[45] Date of Patent: Sep. 5, 2000

[54] NON-CLOSABLE THREADED DRINK-THROUGH SPOUT CAP FOR COMMON BEVERAGE BOTTLES

[76] Inventor: Gary Lee Fishman, 15 Chestnut Way, Manalapan, N.J. 07726

[21] Appl. No.: 09/040,782

[22] Filed: Mar. 18, 1998

[51] Int. Cl.[7] ..... B65D 23/12

[52] U.S. Cl. ..... 215/389; 220/711; 220/717; 222/568; 222/575

[58] Field of Search ..... 222/568, 575, 222/490, 494; 215/387–389, 11.1; 220/703, 705, 717, 711

[56] References Cited

U.S. PATENT DOCUMENTS

| | | | |
|---|---|---|---|
| 2,328,973 | 9/1943 | Goldfisher | 222/575 X |
| 2,372,281 | 3/1945 | Jordan | 215/11.1 |
| 2,550,568 | 4/1951 | Kersh | 215/11.1 |
| 2,569,139 | 9/1951 | Abelson | 220/717 X |
| 2,608,841 | 9/1952 | Rice | 220/717 X |
| 2,792,696 | 5/1957 | Stayart | 220/771 X |
| 2,792,975 | 5/1957 | Yorker | 222/568 X |
| 2,816,548 | 12/1957 | Tupper | 215/11.1 |
| 3,233,798 | 2/1966 | Abbott | 222/568 X |
| 3,273,760 | 9/1966 | Frankenberg | 222/568 X |
| 3,570,726 | 3/1971 | Pomodoro | 222/568 X |
| 4,361,249 | 11/1982 | Tunski et al. . | |
| 4,600,111 | 7/1986 | Brown | 215/11.1 |
| 4,850,496 | 7/1989 | Rudell et al. | 215/11.1 |
| 4,852,776 | 8/1989 | Patton . | |
| 4,915,250 | 4/1990 | Hayes, Jr. | 220/711 |
| 4,917,271 | 4/1990 | Kanner et al. | 222/568 X |
| 4,953,737 | 9/1990 | Meyers | 215/387 X |
| 5,085,330 | 2/1992 | Paulin | 215/387 X |
| 5,150,800 | 9/1992 | Sarter | 215/11.1 X |
| 5,282,541 | 2/1994 | Chen . | |
| 5,381,924 | 1/1995 | Kiefel . | |
| 5,868,323 | 2/1999 | Cantor | 222/575 X |
| 5,871,118 | 2/1999 | Franzese | 220/717 |

FOREIGN PATENT DOCUMENTS

| | | | |
|---|---|---|---|
| 172438 | 2/1952 | Germany | 222/494 |
| 4000334 | 7/1991 | Germany | 222/568 |
| 594838 | 8/1959 | Italy | 222/494 |
| 524688 | 8/1940 | United Kingdom | 222/575 |

*Primary Examiner*—Stephen K. Cronin
*Assistant Examiner*—Robin A. Hylton
*Attorney, Agent, or Firm*—Nancy A. Bird

[57] ABSTRACT

A non-closable device with no movable parts which fits on to twist top beverage bottles reducing the size of the opening and flow of liquid from the bottle. The piece in itself consists entirely of molded plastic. Threading on the interior of the base cylinder (6) enables the unit to be screwed on to the bottle. A spout member (4) with slotted aperture (2) enables liquid to flow through the device at a decreased volume and rate. The piece is screwed onto a beverage bottle and the user drinks through the spout member (4) via the slotted aperture (2). The piece makes drinking from twist top beverage bottles easier for toddlers and/or people who have difficulty drinking from common beverage bottles, and for people in general who simply prefer a more regulated flow and contoured spout.

2 Claims, 3 Drawing Sheets

NON-CLOSABLE THREADED DRINK-THROUGH SPOUT CAP FOR COMMON BEVERAGE BOTTLES

BACKGROUND

1. Field of Invention

This invention relates to drinking device for babies, toddlers, small children and people with disabilities, who cannot drink from a multitude of common beverage containers without at least some difficulty.

2. Background Prior Art

After the stage of drinking from mother's breast and/or drinking from commonly manufactured nipple bottles; and before the stage of drinking directly from cups, cans, and/or bottles; a child often enters a stage of drinking from specialized drinking apparatus commonly referred to as sippers.

At home and when traveling, parents of small children often use sipper cups to enable their small children to drink. A variety of versions of sipping devices and sipper cups exist. These devices typically comprise at least two parts; a container for the liquid and an accompanying top with a drinking device specifically designed to fit its accompanying container.

U.S. Pat. No. 5,381,924; Kiefel's "non spill drinking vessel," discloses an open-top container for holding the liquid and a removable lid configured to fit over the container's open-top; thus the drinking top portion of the sipper cup system cannot be utilized independent of its accompanying container. The sipper top cannot be screwed on to common twist top beverage bottles.

U.S. Pat. No. 5,282,541; Chen's "cap locking device for a water bottle," discloses a water bottle with a locking cap comprising an inner bottle, an outer bottle, a bottle cap having a cap body with a dome shape, a push button and a liftable pusher and a sucking tube where the drinking top portion of the sipper cup system cannot be utilized independent of its accompanying container. The sipper top cannot be screwed on to common twist top beverage bottles.

U.S. Pat. No. 4,600,111; Brown's "toddler cup," discloses a toddler drinking cup comprising a cylindrical member having an aperture at each end thereof; and a plurality of lids each adapted to mate specifically with said first aperture; therefore; any of the the drinking top portions of the toddler cup system cannot be utilized independent of its accompanying container. The sipper top cannot be screwed on to common twist top beverage bottles.

U.S. Pat. No. 4,850,496; Rudell's "infant and child's drinking system," discloses the combination of a container for liquids comprising: an outer shell; a cylindrical inner container having an open top and closed bottom and at least two caps dependent from its undersurface; thereby; the drinking top portion of the sipper cup system cannot be utilized independent of its accompanying container. The sipper top cannot be screwed on to common twist top beverage bottles.

U.S. Pat. No. 4,361,249; Tuneski's "beverage container lid," discloses a lid for beverage container having a top the drinking top portion of the sipper cup system cannot be utilized independent of its accompanying container. The sipper top cannot be screwed on to common twist top beverage bottles.

U.S. Pat. No. 4,852,776; Patton's "Drinking spout for a beverage can," discloses a spout attachment to a can having a raised peripheral rim at the top and a push in tab in its top; however; the sipper top cannot be screwed on to common twist top beverage bottles.

A closable two-piece sport spout drinking system which is conducive for allowing adults to drink from beverage bottle exists. This closable two-piece system is not conducive for enabling a small child to drink from a common beverage bottle because it can easily dose on the child's lips. Additionally, the device requires a sucking action of considerable force and often requires the user to have ample strength to squeeze the beverage bottle in order to facilitate flow. The device also requires a considerable amount of fine motor skills and coordination of the user's mouth and lips.

A threaded cap device that can convert a common water bottle into a nipple bottle exists, however, it is does not provide a spout for sipping. This device comprises a threaded o-ring and a rubber nipple insert. This device is intended for babies still drinking from a standard baby bottle and nipple.

A sipping device that can convert a standard baby bottle into a sipper, called the Susie Sipper, exists. The Susie Sipper cannot be utilized independent of a baby bottle and an accompanying threaded o-ring closure. The Susie Sipper is simply a one-piece rubber spout with a flat circumfrencing rubber base which inserts into a standard baby bottle ring-closure. The Susie Sipper cannot be screwed on to any container as it has no threads and cannot be used on common twist top beverage bottles.

OBJECTS AND ADVANTAGES

Several objects and advantages of this invention are:

(a) a person, whether adult or child, whom needs or prefers drinking from the "non-closable threaded drink-through spout cap for common beverage bottles," would be equipped to so wherever these common beverage bottles are available. Due to the massive distribution and subsequent availability of these common beverage bottles (including, but not limited to water, juice, and soda), the person carrying said device is equipped to turn a common beverage bottle into a sipper virtually everywhere.

(b) this utilitarian device enables a parent of a sipper-using child to travel carrying only the "non-closing threaded drink-through spout cap," rather than carrying a complete sipper cup set consisting of a top and a container. In the event that the sipper-using child does not becomes thirsty, the parent has not unnecessarily carried a significantly large drinking apparatus. The said device efficiently takes up considerably less space than a sipper cup system.

(c) this utilitarian device enables a parent of a sipper-using child to travel carrying only the "non-closing threaded drink-through spout cap," equipping the parent to procure a beverage if and when needed as opposed to transporting liquids unnecessarily.

(d) this utilitarian device enables a parent of a sipper-using child to travel light carrying only the "non-closing threaded drink-through spout cap" facilitating space economy as the device takes up less than space than any sipping apparatus.

(e) The device will make drinking from a twist top beverage bottle easier for babies, toddlers, children, and for people with various motor skill challenges or difficulties than without the device by providing a spouted member.

(f) The device will make drinking from a twist top beverage bottle easier for babies, toddlers, children, and for people with various motor skill challenges or difficulties than without the device by providing decreased flow.

(g) Because the spout member and aperture are static, the non-closable nature of the device will make drinking from a twist top beverage bottle easier than without the device for babies, toddlers, children and for people with various motor skill challenges or difficulties.

Further objects and advantages will become apparent from a consideration of the the ensuing description and drawings.

DRAWINGS FIGURES

In the drawings, this one-part device is represented in three drawings.

REFERENCE NUMERALS IN DRAWINGS

2 slotted aperture

4 spout member

6 base cylinder

8 threads

Figure 1A:
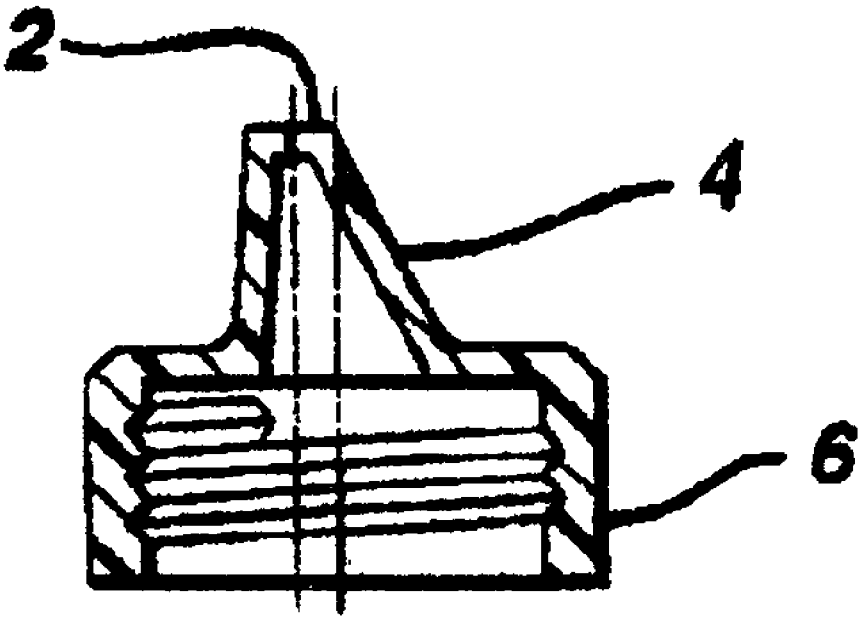
FIG. 1A shows a profile of the invention from a side view perspective.
Figure 1B:
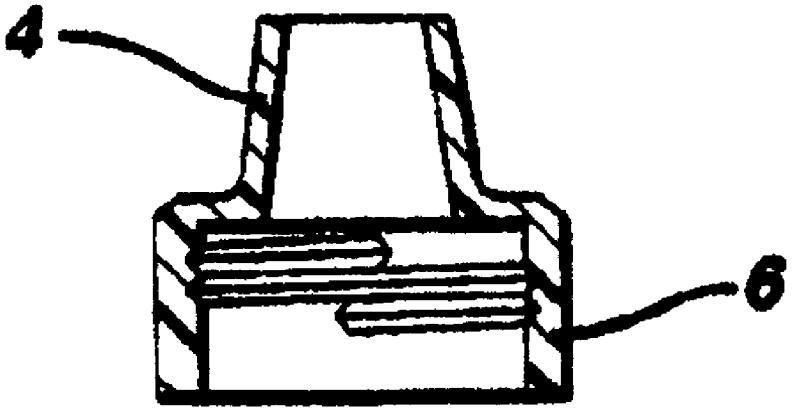
FIG. 1B shows a profile of the invention from a front view perspective.
Figure 1C:
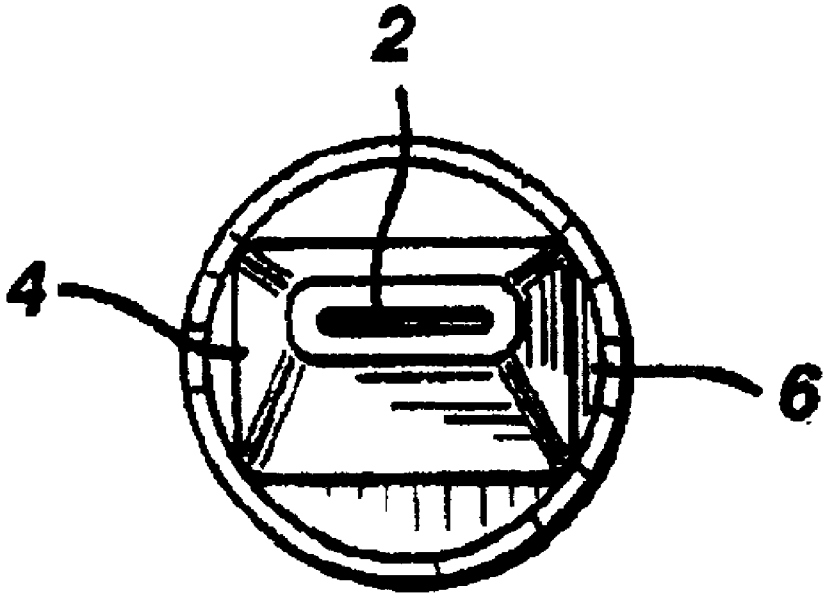
FIG. 1C shows the invention from a top view perspective.

Description—FIGS. 1A, 1B, 1C

A typical embodiment of the device is illustrated in FIGS. 1A (side view), 1B (front view), and 1C (top view). The entire piece consists of injection molded plastic. The invention can consist of various plastics such as (but not limited to): polypropylene, pvc, and polycarbonate.

The slotted aperture 2 located on the top portion of the spout member 4 is a rectangular slot typically 0.496"× 0.045". The spout member 4 is typically 0.535" from its top portion to the beginning of the base cylinder 6. The base cylinder 6 is 0.585" high with a 1.288" diameter. A standard collapsible core part is used in the mold to create the all purpose thread 8 located on the interior wall of the base cylinder 6.

From the description above a number of advantages of my "non-closable threaded drink-through spout cap for common beverage bottles," becomes evident:

a) the use of all-purpose thread makes the invention applicable to a multitude of common bottles which are available in a multitude of locations.

b) the combination of a static spout member and common female threads is a combination which gives individuals who prefer or require to drink from a spout (as opposed to drinking directly from the opening of the common beverage bottle) a means for doing so by providing a smaller contoured opening which is more manageable and which reduces flow; thus facilitates greater overall control for the drinker.

Operation—FIG. 1A

The manner of using the non-closable threaded drink-through spout cap for common beverage bottles is identical to using a cap for common beverage bottles which accompanies the beverage when procured.

Namely, after removing the existing bottle cap and placing it aside; the user holds the beverage bottle container in one hand and the non-closable threaded drink-through spout cap for common beverage bottle in the other. The user holds the base cylinder (6) of said spout cap and secures it to said beverage container by screwing it on clockwise until fit. The "non-closable threaded drink-through spout cap for common beverage bottles" with its female threads (8) located on the interior wall of the base cylinder (6) screws on to the male threads of the common beverage bottle.

The user lifts the beverage bottle causing liquid to flow through the spout member (4) and drinks through the slotted aperture (2).

Summary, Ramifications, and Scope

Accordingly, the reader will see that parents of small children and individuals who prefer or require to drink from a spout (as opposed to drinking directly from the opening of the common beverage bottle) will benefit form this convenience utility device. Namely, the user who keeps the invention on-hand will be equipped for drinking from a spout in virtually any location as common beverage bottles are available virtually everywhere. This enables the user to travel without bringing an entire beverage and/or beverage apparatus with them unnecessarily.

Although the description above contains many specificities, these should not be construed as limiting the scope of the invention but as merely providing illustrations of some of the presently preferred embodiments of this invention. For example, the spout can have various shapes, sizes, contours, and can be set at various angles. The slotted aperture can also have various shape, size and dimension. Additionally, various gaskets can be added to the inner core to add or reduce functionality to the flow.

Thus the scope of invention should be determined by the appended claims and their legal equivalents, rather than by the example given.

I claim:

1. A universal, reusable spout with no moveable parts, comprising a) a hollow cylindrical base having
   i) an outer wall surface,
   ii) an interior wall surface, and
   iii) fastening means on the interior wall surface and b) a spout member, centrally located above the base cylinder and attached to the base cylinder, said spout member comprising
   i) a four sided hollow truncated asymmetrical pyramid with
      (a) two opposed planar, symmetrical end walls, and
      (b) two planar asymmetrical opposed side walls, and
      (c) an opening, at the truncation of the pyramid, wherein one side wall has a substantially shallower slope and its opposed side wall has a substancially steeper slope, and said opening is only slightly offset with respect to the center of the cylindrical base toward the steeper slope.

2. The universal, reusable spout of claim 1, wherein the opening is a slotted opening.

* * * * *